US005298368A

United States Patent [19]

Merkel et al.

[11] Patent Number: 5,298,368

[45] Date of Patent: * Mar. 29, 1994

[54] PHOTOGRAPHIC COUPLER COMPOSITIONS AND METHODS FOR REDUCING CONTINUED COUPLING

[75] Inventors: Paul B. Merkel, Rochester; Edward Schofield, Penfield; Stephen P. Singer, Spencerport, all of N.Y.

[73] Assignee: Eastman Kodak Company, Rochester, N.Y.

[ * ] Notice: The portion of the term of this patent subsequent to Aug. 3, 2010 has been disclaimed.

[21] Appl. No.: 689,436

[22] Filed: Apr. 23, 1991

[51] Int. Cl.[5] ..... G03C 1/34; G03C 7/384; G03C 7/42

[52] U.S. Cl. ..... 430/372; 430/377; 430/386; 430/387; 430/428; 430/430; 430/546; 430/551; 430/554; 430/555

[58] Field of Search ..... 430/551, 546, 558, 372, 430/377, 427, 428, 429, 430, 431, 554, 555, 386, 387, 607, 611, 613, 614

[56] References Cited

U.S. PATENT DOCUMENTS

| | | | |
|---|---|---|---|
| 4,047,954 | 9/1977 | Greenwald | 430/428 |
| 4,113,488 | 9/1978 | Yamada et al. | 430/558 |
| 4,419,431 | 12/1983 | Lischewski et al. | 430/179 |
| 4,686,177 | 8/1987 | Aoki et al. | 430/553 |
| 4,758,498 | 7/1988 | Harada et al. | 430/216 |
| 4,770,987 | 9/1988 | Takahashi et al. | 430/546 |
| 4,840,886 | 6/1989 | Iijima et al. | 430/558 |
| 4,933,271 | 6/1990 | Rody et al. | 430/512 |
| 5,070,007 | 12/1991 | Rody et al. | 430/551 |

FOREIGN PATENT DOCUMENTS

| | | | |
|---|---|---|---|
| 2621203 | 12/1977 | Fed. Rep. of Germany . | |
| 61-51063 | 3/1986 | Japan . | |
| 1156049 | 7/1986 | Japan | 430/558 |
| 3-039950 | 2/1991 | Japan | 430/613 |
| WO90/13060 | 11/1990 | PCT Int'l Appl. . | |

*Primary Examiner*—Lee C. Wright
*Attorney, Agent, or Firm*—Gordon M. Stewart

[57] ABSTRACT

Photographic coupler compositions comprise (a) a pyrazolone magenta dye-forming coupler compound, and (b) a sulfoxide compound in an amount sufficient to reduce continued coupling of the coupler compound during the bleach step of a color photographic process. The sulfoxide compound is of the formula wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms. Additionally, $R_1$ and $R_2$ combined contain at least 12 carbon atoms. Preferably, the coupler composition is substantially free of phenol compounds when $R_1$ and $R_2$ are other than unsubstituted alkyl, alkenyl or alkylene groups.

16 Claims, No Drawings

PHOTOGRAPHIC COUPLER COMPOSITIONS AND METHODS FOR REDUCING CONTINUED COUPLING

FIELD OF THE INVENTION

The present invention relates to photographic coupler compositions which comprise a magenta dye-forming coupler and a sulfoxide compound which reduces continued coupling of the coupler compound between the development and bleach steps of a color photographic process. The invention also relates to color photographic materials including such coupler compositions, methods for reducing continued coupling of magenta dye-forming coupler compounds and methods for the formation of color images, which methods employ the novel coupler compositions.

BACKGROUND OF THE INVENTION

It is well known in the color photography art that color images are produced by a color dye which is formed by a coupling reaction between an oxidized product of an aromatic primary amine color developing agent and a coupler. Various types of cyan, magenta and yellow dye- forming couplers are well known for use in such coupling reactions. The couplers are often used in combination with one or more solvents and/or other additives. For example, the Aoki et al. U.S. Pat. No. 4,686,177 discloses silver halide color photographic materials containing a cyan coupler which may be dissolved in an organic solvent. Aoki et al. broadly disclose numerous organic solvents which may be employed. Japanese reference No. 61-51063 discloses compositions in which a coupler is dissolved in an organic solvent such as dimethylsulfoxide.

It is often desirable in color photography to provide the coupler compounds with improved properties, for example with improved coupler activity, i.e., improved colorability as indicated by the acceleration of the reaction of the coupler with the oxidized developer in forming the color dye and/or by an increase in the color density of the resulting color dye. It is also desirable to provide the dye which is formed from the reaction of the coupler compound with the oxidized developer with improved light stability. For example, the Yamada et al. U.S. Pat. No. 4,113,488 discloses a method for improving the light fastness of a magenta color image by incorporating into a layer containing the magenta color image at least one light fastness improving phenolic compound and at least one synergistic light fastness improving sulfide or sulfoxide compound.

The Takahashi et al. U.S. Pat. No. 4,770,987 discloses silver halide color photographic materials which contain a magenta coupler and an antistain agent in the form of lipophilic fine particles. The antistain agent comprises a sulfone compound and the material is disclosed as preventing stain formation on the non-color developed areas due to aging and the like after processing. The Lischewski et al. U.S. Pat. No. 4,419,431 discloses additional compositions comprising a light-sensitive diazonium compound and a sulfide, sulfoxide or sulfone compound for increasing the light stability of an azo image dye stuff formed by light imaging and development of the composition. The Hirata et al. U.S. Pat. No. 4,758,498 discloses additional photographic compositions including a sulfone compound for preventing fading of and image dye and staining of white background areas.

Many coupler compositions, however, are disadvantageous in that relatively large amounts of a coupler are required to provide satisfactory color density, the reaction rate of the coupler with the oxidized developer is undesirably low, the colored image which is formed from the reaction of the coupler compound with the oxidized developer exhibits unacceptable light instability, and/or the like. Accordingly, a continuing desire exists for coupler compositions of improved activity for use in color photographic materials and methods.

Additionally, various coupler compounds, for example, 2-equivalent pyrazolone magenta couplers, exhibit a phenomenon which is referred to as continued coupling. That is, the couplers often yield high Dmin values when a stop bath is not used between the development and bleach steps of a color photographic process. The continued coupling may be a function of the low "pKa" property of the couplers and reflects the tendency of the couplers to remain significantly ionized under bleaching conditions, thereby allowing reaction with retained developer. Since it is desirable to maintain processing simplicity in color photographic processing by excluding the need for a stop bath, an alternate means of reducing the continued coupling phenomenon without significantly affecting coupler activity is desired.

SUMMARY OF THE INVENTION

Accordingly, it is an object of the present invention to provide novel coupler compositions for use in color photography. It is a more specific object to provide coupler compositions which exhibit a reduction in the continued coupling phenomenon of the coupler compound which occurs during the bleach step of a color photographic process. It is a related object to provide such coupler compositions which exhibit a reduction in the continued coupling phenomenon but which also exhibit good coupler activity, for example, as measured by the photographic gamma value. It is a further object of the invention to provide methods for reducing the continued coupling phenomenon of a coupler compound in the bleach step of a color photographic process. Additional objects of the invention also include the provision of improved silver halide color photographic materials and improved methods for the formation of color images.

These and additional objects are provided by the photographic coupler compositions of the present invention which comprise a magenta dye-forming coupler compound, preferably a pyrazolone magenta dye-forming coupler compound, and a sulfoxide compound in an amount sufficient to reduce the continued coupling phenomenon of the coupler compound in the bleach step of a color photographic process. Specifically, the sulfoxide compound is of the formula $$R_1-\overset{\overset{\displaystyle O}{\|}}{S}-R_2$$

wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms. In preferred embodiments, the coupler compositions are free of phenol compounds or $R_1$ and $R_2$ are individually selected from straight and branched chain alkyl groups, alkenyl groups and alkylene groups.

It has been discovered that the sulfoxide compound included in the coupler compositions of the present invention reduces the continued coupling effect exhibited by magenta dye-forming couplers, such as the two-equivalent pyrazolone magenta dye-forming couplers, in the bleach step of a color photographic process, particularly without significantly reducing the activity of the coupler compound. The coupler compositions of the present invention are therefore suitable for use in improved silver halide color photographic materials and in improved methods for the formation of color images.

These and additional advantages will be more fully apparent in view of the following detailed description.

DETAILED DESCRIPTION

The photographic coupler compositions of the present invention comprise a dye-forming coupler, preferably a magenta coupler such as a two-equivalent pyrazolone magenta coupler, and a sulfoxide compound in an amount sufficient to reduce the continued coupling phenomenon exhibited by the coupler compound in the bleach step of a conventional color photographic process. As will be set forth in detail below in the examples, a reduction in the continued coupling phenomenon may be evident from the difference between the Dmin values obtained with and without the use of a stop bath in developing processes. The reduction in the continued coupling phenomenon allows the color photographic process to be simplified in that a stop bath is not required. Additionally, the coupler compositions according to the present invention exhibit the reduced continued coupling phenomenon without also exhibiting a significant reduction in coupler activity, for example, as measured by the photographic gamma value.

The sulfoxide compound which is employed in the coupler compositions of the present invention may serve as a solvent for the coupler compound and/or may be used as a non-solvent additive. It is important that the sulfoxide compound employed in the present invention contain sufficient ballast to minimize its water solubility, volatility and diffusivity. Sulfoxide compounds suitable for use in the coupler compositions of the present invention are of the formula $$R_1-\overset{\overset{\displaystyle O}{\|}}{S}-R_2$$

wherein $R_1$ and $R_2$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl, acyloxy, carbonamido and carbamoyl groups and halogen atoms; a phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined contain at least 12 carbon atoms.

In a preferred embodiment, $R_1$ and $R_2$ are individually selected from straight and branched chain alkyl groups, alkenyl groups and alkylene groups and $R_1$ and $R_2$ combined contain at least 12 carbon atoms. More preferably, $R_1$ and $R_2$ combined contain at least 14 carbon atoms. In another preferred embodiment, $R_1$ and $R_2$ each comprise a branched alkyl group and combined contain from about 16 to about 24 carbon atoms. In further embodiments, $R_1$ and $R_2$ are the same, thereby forming a bis compound, or $R_1$ and $R_2$ form a ring with the sulfur atom. Preferred halogen substituents for the sulfoxide compounds comprise chlorine and/or fluorine. Also suitable for use in the present invention are is sulfoxide compounds in which $R_1$ and/or $R_2$ is substituted with a nucleophilic leaving group such as a hydroxy, alkoxy, cyano, amino, acyloxy, carbonomido or sulfonomido group on the beta carbon. However, since these types of sulfoxide compounds may be unstable toward beta elimination (reverse Michael reaction), these compounds are somewhat less preferred.

Suitable sulfoxide compounds for use in the coupler compositions of the present invention include, but are not limited to, the following:

$$\text{n-}C_7H_{15}S(=O)C_7H_{15}\text{-n} \quad \text{(I)}$$

$$CH_3(CH_2)_3CH(C_2H_5)CH_2S(=O)CH_2CH(C_2H_5)(CH_2)_3CH_3 \quad \text{(II)}$$

$$\text{n-}C_9H_{19}S(=O)C_9H_{19}\text{-n} \quad \text{(III)}$$

$$C_2H_5S(=O)C_{16}H_{33}\text{-n} \quad \text{(IV)}$$

$$CH_3(CH_2)_4C(CH_3)_2CH_2S(=O)CH_2C(CH_3)_2(CH_2)_4CH_3 \quad \text{(V)}$$

$$CH_3S(=O)CH_2CH(C_6H_{13}\text{-n})C_8H_{17}\text{-n} \quad \text{(VI)}$$

(VII)

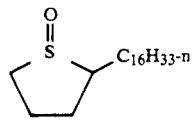

(VIII)

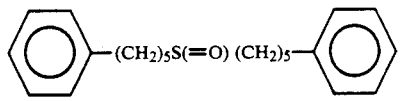

(IX)

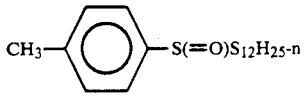

(X)

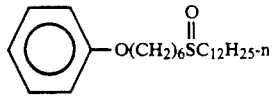

$$CH_3S(=O)(CH_2)_{16}C(=O)N(C_4H_9)_2 \quad \text{(XI)}$$

(XII)

$$C_8H_{17}S(=O)(CH_2)_{12}\overset{\overset{\displaystyle O}{\|}}{O}CCH_3$$

It is also preferred that the coupler compositions according to the present invention are free of phenol compounds. By "substantially free," it is meant that the coupler composition is free of phenol compounds in amounts that would adversely affect continued coupling.

As noted above, the sulfoxide compound employed in the coupler compositions of the present invention may act as a solvent for the dye-forming coupler. One or more additional organic (and preferably non-volatile, high boiling) solvents for the coupler compound may also be employed in the compositions of the present invention. Generally, conventional organic coupler solvents are known in the art and may be employed when the sulfoxide compound of the present invention is used in an additive amount which is not sufficient to result in a solution of the coupler compound. Examples of conventional organic solvents which may be used in the present compositions are described in the Examples set forth below.

The sulfoxide compound is employed in the coupler compositions of the present invention in an amount sufficient to reduce the continued coupling phenomenon of the dye-forming coupler. In most applications, it is preferred that the dye-forming coupler and the sulfoxide compound are employed in a weight ratio of from about 1:0.1 to about 1:10 in order to effect an increase in the activity of the dye-forming coupler.

As noted above, it is preferred that the dye-forming coupler included in the present coupler compositions comprises a magenta dye-forming coupler. Couplers which form magenta dyes upon reaction with oxidized color developing agents are well known in the art and are described in such representative patents and publications as: U.S. Pat. Nos. 2,600,788; 2,369,489; 1,969,479; 2,311,082; 3,061,432; 3,725,067; 4,120,723; 4,500,630; 2,343,703; 2,311,082; 3,152,896; 3,519,429; 3,062,653; 2,908,573; 4,774,172; 4,443,536; 3,935,015; 4,540,654; 4,581,326; European Patent Applications 284,239; 284,240; 240,852; 170,164; 177,765 and "Farbkuppler-eine Literatur}bersicht," published in Agfa Mitteilungen, Band III, pp. 126–156 (1961), the disclosures of which are incorporated herein by reference.

More preferably, the coupler compound included in the compositions of the present invention comprises a 2-equivalent pyrazolone magenta dye-forming coupler compound of the formula

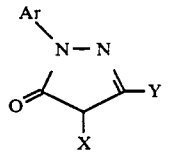

wherein:

Ar is an unsubstituted aryl group, or an aryl group or a pyridyl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl;

Y is an anilino group, an acylamino group, a ureido group or one of said groups substituted with one or more substituents selected from halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is hydrogen or a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkyl thio, aryl thio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

As is well known in the photographic art, a coupler compound should be nondiffusible when incorporated in a photographic element. That is, the coupler compound should be of such a molecular size and configuration that it will exhibit substantially no diffusion from the layer in which it is coated. To achieve this result, the total number of carbon atoms contained in Y should be at least 6. Preferably, Y contains from 6 to about 30 carbon atoms.

In a preferred embodiment of the magenta dye-forming coupler, Ar is of the formula

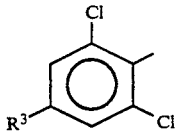

wherein $R^3$ is selected from the group consisting of halogen atoms and cyano, alkylsulfonyl, arylsulfonyl, sulfamoyl, sulfonamide, carbamoyl, carbonamido, ureido, alkoxycarbonyl, aryloxycarbonyl, acyloxy, alkoxy, aryloxy, nitro and trifluoromethyl groups. It is further preferred that Y is of the formula

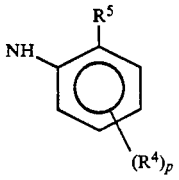

wherein p is from zero to 2 and each $R^4$ is in a meta or para position with respect to $R^5$;

each $R^4$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups; and $R^5$ is selected from the group consisting of hydrogen, halogen atoms and alkyl, alkoxy, aryloxy alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups. Preferably, $R^5$ is a chlorine atom or an alkoxy group.

It is further preferred that the coupling-off group X is of the general formula

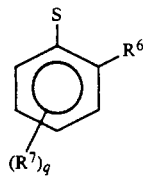

wherein $R^6$ and $R^7$ are individually selected from hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and $R^7$ may be in the meta or para position with respect to the sulfur atom. The groups from which $R^6$ and $R^7$ selected may optionally be substituted. It is particularly preferred that $R^6$ has at least one carbon atom and that the total number of carbon atoms in $R^6$ and $R^7$ is at least about 5 but not greater than about 25.

Suitable pyrazolone magenta dye-forming coupler compounds for use in the compositions of the present invention include, but are not limited to, the following M1-M20:

M1

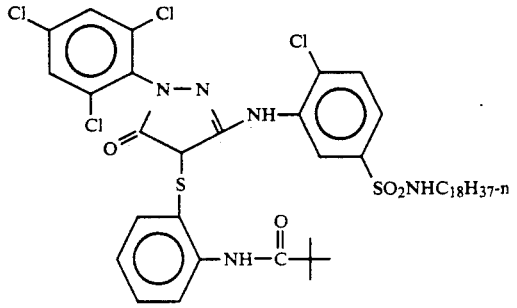

M2

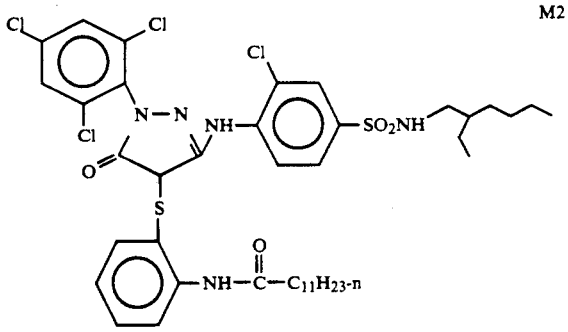

M3

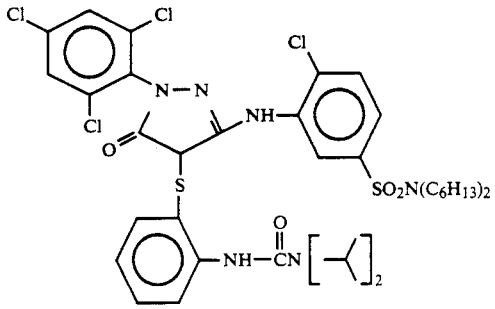

M4

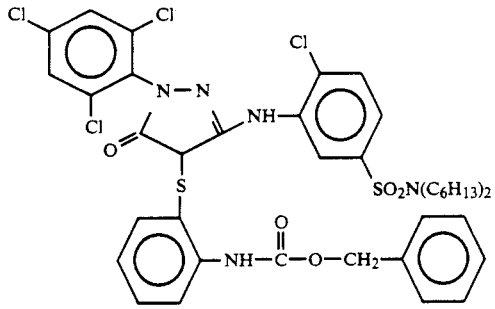

M5

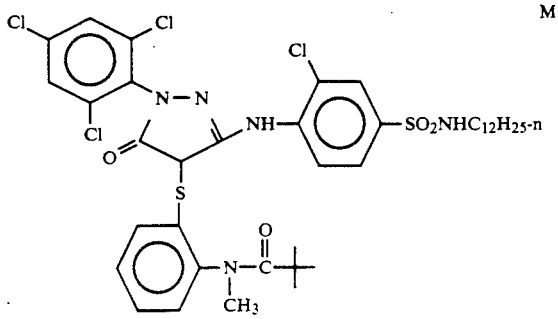

-continued
M6
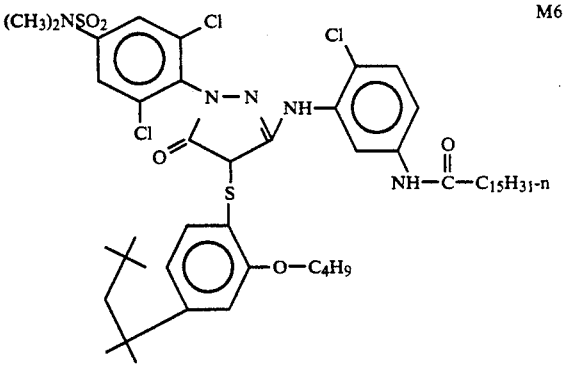
M10
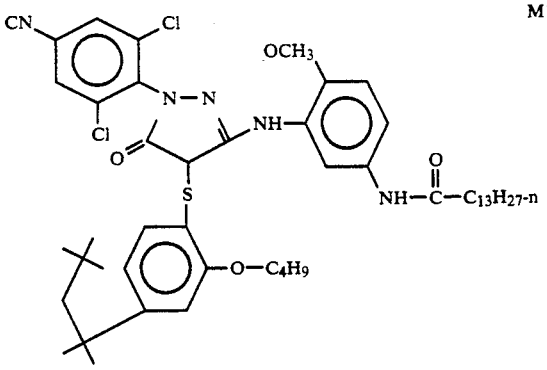
M7
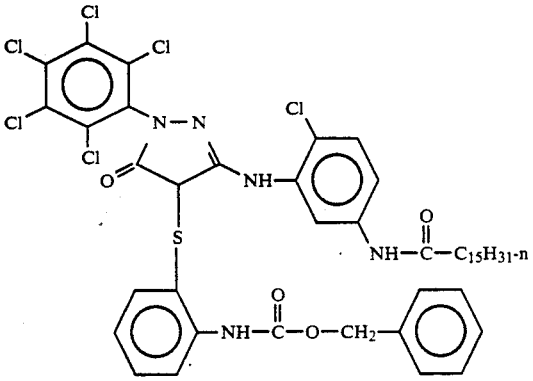
M8
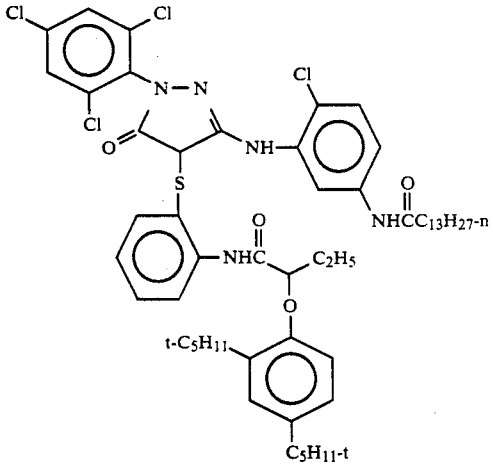
M9
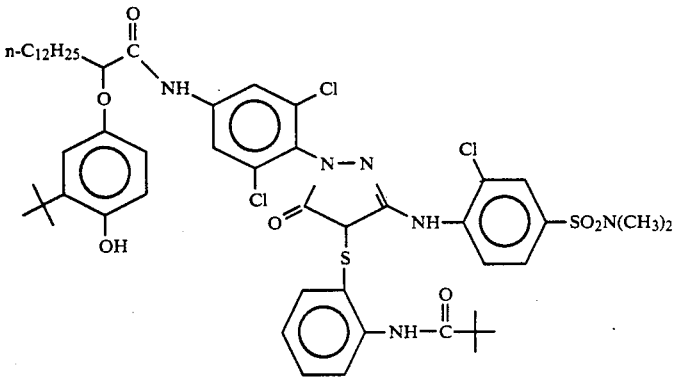

M11
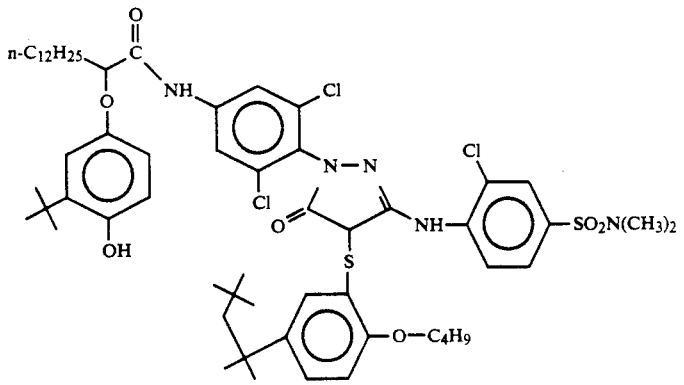
M12
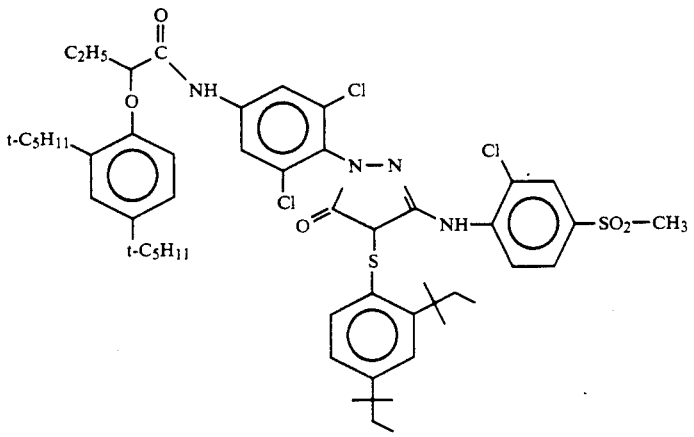
M13
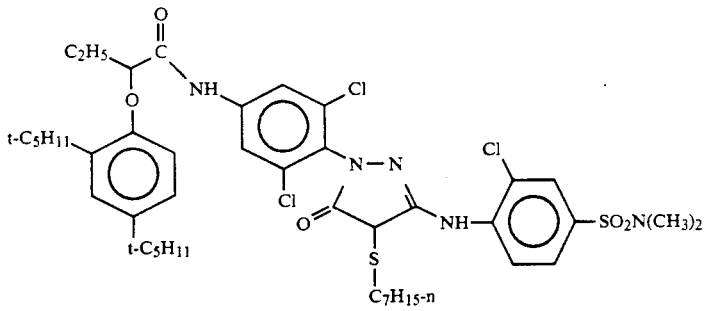
M14
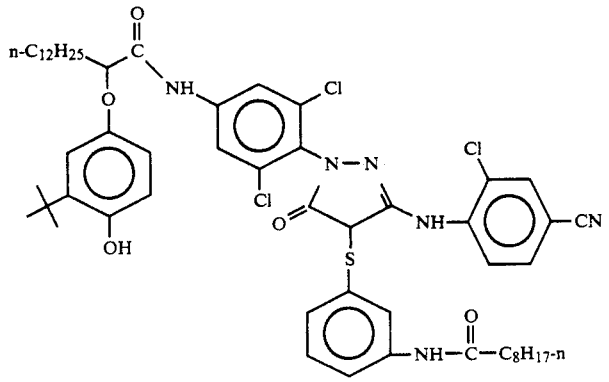

M15
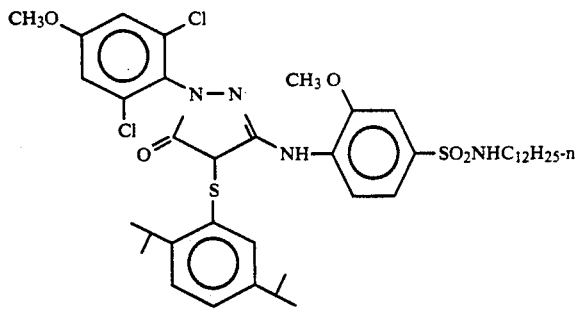
M16
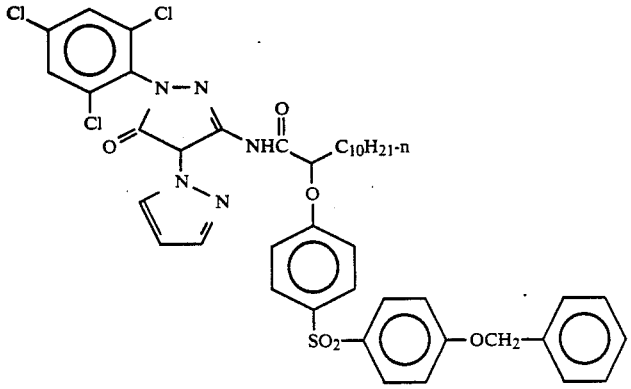
M17
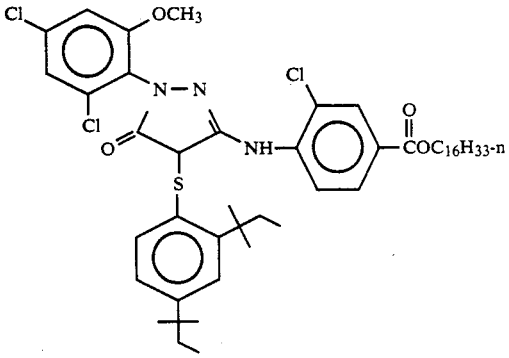
M18
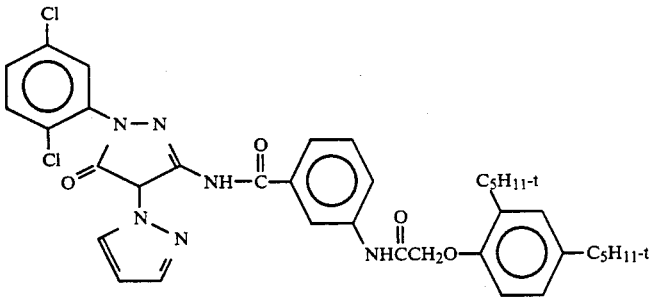
M19
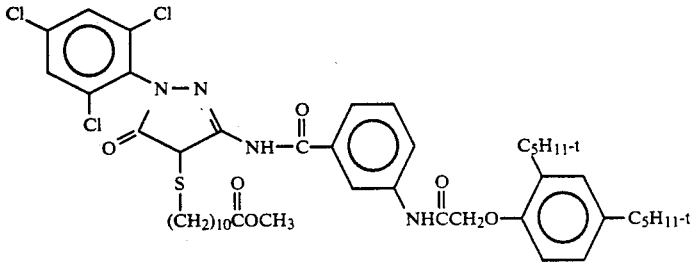

-continued

M20

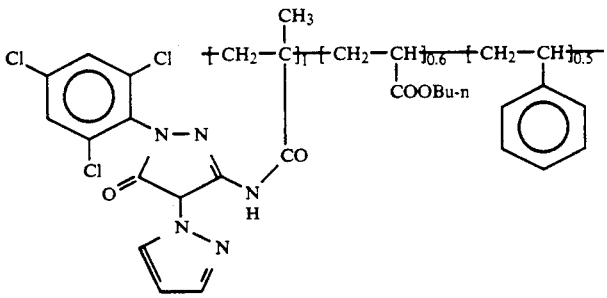

The photographic coupler compositions according to the present invention are employed in color photographic materials in a manner well known in the color photographic art. For example, a supporting substrate is coated with a silver halide emulsion and the coupler composition of the present invention comprising a pyrazolone magenta dye-forming compound and a sulfoxide compound in an amount sufficient to reduce continued coupling of the coupler compound in the bleach step of a color photographic process. The photographic material is then imagewise exposed in a manner well known in the color photography art, followed by development with an aromatic primary amine developer. Owing to the reduction in the continued coupling phenomenon, the use of a stop bath in the process is not required. Rather, the development step may be followed by the original bleach step. As is well known in the art, the oxidation product of the aromatic primary amine developer reacts with the coupler compound to form the color dye images.

Photographic elements in which the compositions of this invention are incorporated can be simple elements or multilayer, multicolor elements. The compositions of this invention can be incorporated into layers containing silver halide emulsions of a variety of types known in the art, such as fine or course grain emulsions, tabular grain emulsions, silver chlorobromide and silver bromoiodide emulsions. Useful tabular grain emulsions are described in *Research Disclosure*, Item 22534, January, 1983 and in U.S. Pat. No. 4,748,106. The layers in which the compositions of this invention are incorporated may also contain other coupler components, such as colored masking couplers, image-modifying couplers (including DIR's and timed or switched DIR's such as those described in U.S. Pat. Nos. 3,148,062, 3,227,554, 3,733,201, 4,409,323, and 4,248,962) and bleach accelerator releasing couplers (including those described in EP 193,389).

The compositions and methods of the present invention are demonstrated by the following examples in which references are to parts by weight unless otherwise specified. The sulfoxide compounds which are employed in the examples according to the present invention are identified by the numerals I–XII as set forth above. Additionally, conventional coupler solvents S1 and S2, comprising mixed tritolyl phosphates and dibutyl phthalate, respectively, were also employed for comparative purposes in the examples.

EXAMPLE 1

This example demonstrates the reduction in the continued coupling phenomenon exhibited by a photographic coupler composition according to the present invention as compared with coupler compositions containing conventional coupler solvents. More specifically, dispersions of coupler compound M7 as set forth above were prepared using the various coupler solvents set forth in Table I. The dispersions contained a 1:1 ratio of coupler compound to coupler solvent. The respective dispersions were coated on transparent acetate supports at a level of 0.075 mmoles/ft$^2$ of the coupler compound together with a silver halide emulsion at a level of 100 mg/ft$^2$ of silver. Hardened films of the coated supports were exposed and processed according to the standard Kodak Flexicolor C41 Process, according to the C41 Process including the use of an acid stop bath between the developer and bleached steps, according to the C41 Process with the bleach pH adjusted to 6.0, and according to the C41 Process including an acid stop bath between the developer and bleach steps and with the bleach pH adjusted to 6.0. The status M green densities of the processed films were measured as a function of exposure and then used to determine the photographic gamma values and the Dmin values. The differences between the Dmin values obtained with and without a stop bath for the standard C41 Process and for the C41 Process using a bleach pH of 6.0, respectively, were calculated. The determined gamma values and the calculated differences between the Dmin values (Δ Dmin) for each solvent are also set forth in Table I.

TABLE I

| Coupler Solvent | Gamma | Δ Dmin Std C41 Process | Δ Dmin pH = 6.0 Bleach |
|---|---|---|---|
| S2 | 1.59 | 0.14 | 0.35 |
| S2 | 1.10 | 0.07 | 0.26 |
| II | 1.64 | 0.03 | 0.15 |

The Δ Dmin values set forth in Table I demonstrate that use of the coupler composition according to the present invention including the sulfoxide coupler solvent exhibited a reduction in the continued coupling phenomenon in both the standard C41 Process and in the C41 Process employing a pH of 6.0 bleach. In practice, the process employing the bleach having a pH of 6.0 accentuates the continued coupling problem and generally may serve as an indicator for the behavior of a "seasoned bleach." Additionally, the use of the coupler composition according to the present invention resulted in an increased gamma value, thereby indicating good coupler activity.

EXAMPLE 2

This example demonstrates the use of coupler compositions according to the present invention containing a polymeric pyrazolone magenta dye-forming coupler. Specifically, latex dispersions of the core-shell polymeric coupler M20 as described above were loaded with coupler solvents as described in Table II. The latex dispersions contained a 1:05 weight ratio of coupler to coupler solvent. Specifically, dispersions of the coupler solvents were made by shearing a mixture of a first solution containing the coupler solvent (3.0 g) and ethylacetate (1.0 g) and a second solution of a 12.5 weight percent gelatin solution (15 ml), a 10% Alkanol XC (1.9 ml) and water (9.1 ml) three times in a colloid mill. In preparing the latex dispersions, gelatin, a spreading agent and water were mixed at 40° C. and the polymeric coupler was added thereto with stirring at 40° C. The coupler solvent dispersion was then added and the resulting mixture was stirred at 40° C. for three hours. A silver bromide iodide emulsion and tetraazaindine were added to the dispersion just prior to coating. The dispersion was coated on an acetate support in the following format:

| | | |
|---|---|---|
| Gelatin | 250 | mg/ft$^2$ |
| Hardener | 1.75% | of total gel |
| Gelatin | 350 | mg/ft$^2$ |
| Coupler (M20) | $1.5 \times 10^{-4}$ | mole/ft$^2$ |
| Coupler:Solvent | 1:0.5 | (w/w) |
| Silver Halide | 84.2 | mg/ft$^2$ |
| Emulsion | 1.75 | g/mole Ag |
| Tetraazaindine | | |

The resulting hardened strips were exposed for 1/25 second on a 1B sensitometer with Kodak Wratten 9 and DL V filters and a 0–4 density step wedge. The exposed strips were processed according to the following procedure:

| Solution | Time | Temp. | Agitation |
|---|---|---|---|
| KF12 Developer | 3'15" | 100° F. | $N_2$ Burst |
| FLEXICOLOR Bleach | 4' | " | Air |
| Wash | 3' | " | None |
| KF12 fix | 4' | " | $N_2$ burst |
| Wash | 4' | " | None |

The processed strips were subjected to measurement of the status M green density using an T5 densitometer. In order to assess continued coupling, the coatings were processed using both the procedure described above and a similar procedure including a 45 second stop bath immediately after the development step. Δ Dmin values were calculated as described in Example 1. Photographic gamma values were also determined. The results are set forth in Table II.

TABLE II

| Coupler Solvent | Gamma | Δ Dmin (+/−stop) |
|---|---|---|
| S1 | 2.40 | 0.36 |
| S2 | 2.42 | 0.36 |
| II | 2.64 | 0.32 |

The results set forth in Table II further demonstrate a reduction in the continued coupling phenomenon exhibited by use of the coupler composition according to the present invention as indicated by a reduced Δ Dmin value. Additionally, the use of the coupler composition according to the present invention resulted in an increased gamma value, thereby evidencing good coupler activity.

EXAMPLE 3

This example demonstrates coupler compositions according to the present invention containing various coupler compounds as set forth in Table III and various coupler solvents as also set forth in Table III. The compositions contained the coupler compounds and coupler solvents in a weight ratio of 1:1. Compositions were prepared and coated on transparent supports in a manner similar to that described in Example 1 at a level of 0.05 mmoles of coupler/ft$^2$ together with a silver halide emulsion. The resulting hardened films were exposed and processed also in manners similar to those described in Example 1. The status M green densities of processed films were measured as a function of exposure and used to determine the photographic gamma and Δ Dmin values, the results of which are also set forth in Table III.

TABLE III

| Coupler Compound | Coupler Solvent | Gamma | Δ Dmin Std. C41 Process | Δ Dmin pH = 6.0 Bleach |
|---|---|---|---|---|
| M1 | S1 | 1.56 | 0.15 | 0.38 |
| M1 | S2 | 1.47 | 0.22 | 0.45 |
| M1 | II | 1.56 | 0.06 | 0.19 |
| M4 | S1 | 2.18 | 0.25 | 0.59 |
| M4 | S2 | 1.98 | 0.32 | 0.60 |
| M4 | II | 1.83 | 0.06 | 0.16 |
| M9 | S1 | 1.85 | 0.07 | 0.21 |
| M9 | S2 | 2.01 | 0.15 | 0.36 |
| M9 | II | 1.82 | 0.00 | 0.08 |
| M11 | S1 | 2.40 | 0.02 | 0.12 |
| M11 | S2 | 2.68 | 0.02 | 0.12 |
| M11 | II | 1.82 | −0.02 | −0.01 |
| M13 | S1 | 2.95 | 0.11 | 0.36 |
| M13 | S2 | 2.87 | 0.22 | 0.60 |
| M13 | II | 2.84 | 0.04 | 0.10 |

The results set forth in Table III further demonstrate that the use of the coupler compositions according to the present invention containing a sulfoxide coupler solvent provides a significant reduction in the continued coupling phenomenon as measured by Δ Dmin, in both the standard C41 Process and the C41 Process employing a bleach pH of 6.0. Additionally, the coupler compositions according to the present invention exhibited good coupler activity as indicated by no significant reduction in the gamma values.

The dispersions were coated on the transparent support in the following format:

| | | |
|---|---|---|
| Gelatin | 250 | mg/ft$^2$ |
| Hardener | 1.75% | of total gel |
| Gelatin | 350 | mg/ft$^2$ |
| Coupler | 0.050 | mmol/ft$^2$ |
| Silver Halide | 100 | mgAg/ft$^2$ |
| Emulsion | | |

Support

The preceding examples are set forth to illustrate specific embodiments of the invention and are not intended to limit the scope of the compositions and methods of the present invention. Additional embodiments and advantages within the scope of the claimed invention will be apparent to one of ordinary skill in the art.

What is claimed is:

1. A color photographic material, comprising a supporting substrate coated with a silver halide emulsion and a magenta coupler composition comprising (a) a pyrazolone magenta dye-forming coupler compound, and (b) a sulfoxide compound in an amount sufficient to reduce continued coupling of the coupler compound during the bleach step of a color photographic process, the sulfoxide compound being of the formula

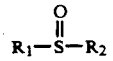

wherein $R_1$ and $R_2$ are individually selected from the group consisting of unsubstituted straight and branched chain alkyl groups and unsubstituted straight and branched chain alkenyl groups; straight and branched chain alkyl groups, straight and branched chain alkenyl groups and straight and branched chain alkylene groups, containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; wherein $R_1$ and $R_2$ combined contain at least 12 carbon atoms; and further wherein $R_1$ and $R_2$ do not form a ring with the sulfur atom; said magenta coupler composition being free of phenol compounds.

2. A color photographic material as defined by claim 1, wherein $R_1$ and $R_2$ are the same.

3. A color photographic material as defined by claim 1, wherein $R_1$ and $R_2$ combined contain at least 14 carbon atoms.

4. A color photographic material as defined by claim 1, wherein $R_1$ and $R_2$ are individually selected from the group consisting of said unsubstituted straight and branched chain alkyl groups, said unsubstituted straight and branched chain alkenyl groups and said unsubstituted straight and branched chain alkylene groups.

5. A color photographic material as defined by claim 1, wherein $R_1$ and $R_2$ each comprise said unsubstituted branched chain alkyl group, and $R_1$ and $R_2$ combined contain from about 16 to about 24 carbon atoms.

6. A color photographic material as defined by claim 1, wherein the pyrazolone magenta dye-forming coupler compound is of the formula

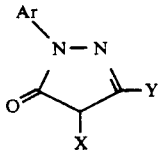

wherein:

Ar is an unsubstituted aryl group, or an aryl group or a pyridyl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl;

Y is an unsubstituted anilino group, an unsubstituted acylamino group, an unsubstituted ureido group or one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is hydrogen or a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

7. A color photographic material as defined by claim 6, wherein Ar is of the formula

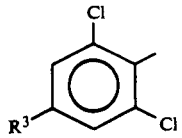

wherein $R^3$ is selected from the group consisting of halogen atoms and cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups.

8. A color photographic material as defined by claim 6, wherein Y is an anilino group of the formula

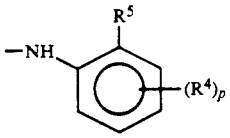

wherein p is from zero to 2 and each $R^4$ is in a meta or para position with respect to $R^5$;

each $R^4$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups; and $R^5$ is selected from the group consisting of hydrogen, halogen atoms and alkyl, alkoxy, aryloxy alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

9. A color photographic material as defined by claim 6, wherein X is of the formula

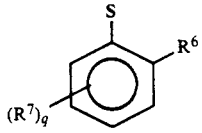

wherein $R^6$ and $R^7$ are individually selected from hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and $R^7$ is in the meta or para position with respect to the sulfur atom.

10. A color photographic material as defined by claim 1, wherein the dye-forming coupler and the sulfoxide compound are included in a weight ratio of from about 1:0.1 to about 1:10.

11. A color photographic material as defined by claim 1, wherein the magenta coupler composition further includes a third component comprising a non-volatile organic solvent.

12. A color photographic material, comprising a supporting substrate coated with a silver halide emulsion and a coupler composition comprising (a) a pyrazolone magenta dye-forming coupler compound, and (b) a sulfoxide compound in an amount sufficient to reduce continued coupling of the coupler compound during the bleach step of a color photographic process, the sulfoxide compound being of the formula $$R_1-\overset{\overset{\displaystyle O}{\|}}{S}-R_2$$

wherein $R_1$ and $R_2$ are individually selected from unsubstituted straight and branched chain alkyl groups and unsubstituted straight and branched chain alkenyl groups, $R_1$ and $R_2$ combined contain at least 12 carbon atoms, and $R_1$ and $R_2$ do not form a ring with the sulfur atom.

13. A method for reducing continued coupling of a pyrazolone magenta dye-forming coupler compound during the bleach step of a color photographic process, comprising (a) providing a color photographic material containing the dye-forming coupler in a photographic layer in combination with a sulfoxide compound, the sulfoxide compound being included in an amount sufficient to reduce the continued coupling of the coupler compound, the sulfoxide compound being of the formula $$R_1-\overset{\overset{\displaystyle O}{\|}}{S}-R_2$$

wherein $R_1$ and $R_2$ are individually selected from the group consisting of unsubstituted straight and branched chain alkyl groups and unsubstituted straight and branched chain alkenyl groups; straight and branched chain alkyl groups, straight and branched chain alkenyl groups and straight and branched chain alkylene groups, containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; wherein $R_1$ and $R_2$ combined contain at least 12 carbon atoms; and further wherein $R_1$ and $R_2$ do not form a ring with the sulfur atom; said combination being free of phenol compounds; (b) imagewise exposing the color photographic material; (c) developing the exposed color photographic material; and (d) bleaching the developed color photographic material.

14. A method for reducing continued coupling of a pyrazolone magenta dye-forming coupler compound during the bleach step of a color photographic process, comprising (a) providing a color photographic material containing the dye-forming coupler in a photographic layer in combination with a sulfoxide compound, the sulfoxide compound being included in an amount sufficient to reduce the continued coupling of the coupler compound, the sulfoxide compound being of the formula $$R_1-\overset{\overset{\displaystyle O}{\|}}{S}-R_2$$

wherein $R_1$ and $R_2$ are individually selected from unsubstituted straight and branched chain alkyl groups and unsubstituted straight and branched chain alkenyl groups, $R_1$ and $R_2$ combined contain at least 12 carbon atoms, and $R_1$ and $R_2$ do not form a ring with the sulfur atom; (b) imagewise exposing the color photographic material; (c) developing the exposed color photographic material; and (d) bleaching the developed color photographic material.

15. A method for the formation of color images, comprising (A) imagewise exposing a photographic layer, and (B) developing the exposed image, wherein the photographic layer comprises a silver halide emulsion and a magenta coupler composition comprising (a) a pyrazolone magenta dye-forming coupler compound, and (b) a sulfoxide compound in an amount sufficient to reduce continued coupling of the coupler compound during a bleach step subsequent to development, the sulfoxide compound being of the formula $$R_1-\overset{\overset{\displaystyle O}{\|}}{S}-R_2$$

wherein $R_1$ and $R_2$ are individually selected from the group consisting of unsubstituted straight and branched chain alkyl groups and unsubstituted straight and branched chain alkenyl groups; straight and branched chain alkyl groups, straight and branched chain alkenyl groups and straight and branched chain alkylene groups, containing at least one substituent selected from the group consisting of alkoxy, aryloxy, aryl, alkoxycarbonyl, aryloxycarbonyl, acyloxy, carbonamido and carbamoyl groups and halogen atoms; an unsubstituted phenyl group; and a phenyl group containing at least one substituent selected from the group consisting of alkyl, alkoxy, aryloxy, aryl, alkoxycarbonyl, aryloxycarbonyl, acyloxy, carbonamido and carbamoyl groups and halogen atoms; wherein $R_1$ and $R_2$ combined contain at least 12 carbon atoms; and further wherein $R_1$ and $R_2$ do not form a ring with the sulfur atom; said magenta coupler composition being free of phenol compounds.

16. A method for the formation of color images, comprising (A) imagewise exposing a photographic layer, and (B) developing the exposed image, wherein the photographic layer comprises a silver halide emulsion and a coupler composition comprising (a) a pyrazolone magenta dye-forming coupler compound, and (b) a sulfoxide compound in an amount sufficient to reduce continued coupling of the coupler compound during a bleach step subsequent to development, the sulfoxide compound being of the formula

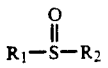
wherein $R_1$ and $R_2$ are individually selected from unsubstituted straight and branched chain alkyl groups and unsubstituted straight and branched chain alkenyl groups, $R_1$ and $R_2$ combined contain at least 12 carbon atoms, and $R_1$ and $R_2$ do not form a ring with the sulfur atom.
* * * * *